US006082918A

United States Patent [19]

Gueret

[11] Patent Number: 6,082,918

[45] Date of Patent: Jul. 4, 2000

[54] ASSEMBLY HAVING A PISTON FOR PACKAGING AND APPLYING A PULVERULENT, LIQUID OR PASTY PRODUCT

[75] Inventor: Jean-Louis H. Gueret, Paris, France

[73] Assignee: L'Oreal, Paris, France

[21] Appl. No.: 09/219,886

[22] Filed: Dec. 24, 1998

[30] Foreign Application Priority Data

Jan. 26, 1998 [FR] France ..... 98 00792

[51] Int. Cl.[7] ..... A46B 11/00

[52] U.S. Cl. ..... 401/126; 401/127; 401/129

[58] Field of Search ..... 401/123, 126, 401/129, 118, 122, 127, 141, 142, 171, 172, 173, 179, 180, 181

[56] References Cited

U.S. PATENT DOCUMENTS

Re. 21,757 4/1941 Deakers et al. .
2,718,299 9/1955 Atwater et al. .
3,298,054 1/1967 Humble et al. .
5,011,317 4/1991 Gueret .
5,336,005 8/1994 Moeck et al. .

FOREIGN PATENT DOCUMENTS 0 263 329 A2 4/1988 European Pat. Off. .
0 384 026 A2 11/1990 European Pat. Off. .
2 720 238 12/1995 France .

*Primary Examiner*—Henry J. Recla
*Assistant Examiner*—Peter deVore
*Attorney, Agent, or Firm*—Oblon, Spivak, McClelland, Maier & Neustadt, P.C.

[57] ABSTRACT

The present invention relates to an assembly (1) for packaging and applying a pulverulent liquid or pasty product (P), which includes a reservoir (4) for the product, an application member (3) equipped with an application element (48) intended to be placed so as to bear elastically on the product, and an elastic bearing (44) exerting a bearing force of the application element (48) on this product. Moreover, the bearing force is adjusted to a determined and substantially constant value as the level of product in the reservoir diminishes.

16 Claims, 4 Drawing Sheets

ASSEMBLY HAVING A PISTON FOR PACKAGING AND APPLYING A PULVERULENT, LIQUID OR PASTY PRODUCT

BACKGROUND OF THE INVENTION

1. Field of the Invention

The present invention relates to an assembly for packaging a pulverulent, liquid or pasty product and for applying it onto a support. More particularly, the invention relates to an assembly for applying cosmetic products such as, for example, make-up products such as mascaras or blusher, and dermatological products such as treatment creams, etc.

2. Description of the Related Art

Conventional devices for applying make-up or care products include, in particular, a body which accommodates a reservoir containing the product, a cap intended for closing the reservoir and an applicator holder integral with the cap and which supports an application element (or end-piece) capable of dispensing the product with a view to applying it in the desired place. Generally speaking, the application element is adapted to the product to be applied and may be a brush, a mascara brush or a specific application end-piece made from foam, etc.

A packaging and application assembly of this type is described in applicant's FR-A-2,720,238. This assembly comprises a piston placed in the reservoir and having at least one orifice for the exit of the product, and an elastic element for providing pressure from the application element onto the piston so as to cause the product to exit via the orifice and thereby to load the product onto the application element during closure of the cap over the reservoir.

By means of tests carried out by applicant, it was observed that in this assembly, the degree of loading of the application element with product was variable from the start of use up to the end of use: the pressure exerted on the piston by the application element when the reservoir is full causes the application element being loaded with a considerable amount whereas, when the reservoir is practically empty, the application element is poorly loaded.

SUMMARY OF THE INVENTION

There is therefore a need for an assembly which is capable of loading the product onto an application element and dispensing the product homogeneously and uniformly from the start up to the end of consumption of the product contained in the reservoir.

It is therefore an object of the invention to provide an application element which will be loaded with a substantially constant quantity of product, irrespective of the level of filling of the reservoir, by of a substantially constant bearing of the application element on the piston.

A further object of the invention is to provide an assembly which may be refilled simply and easily after the product in the reservoir has been used up.

According to an aspect of the invention, the above and other objects are achieved by an assembly for packaging and applying a pulverulent, liquid or pasty product, which includes a reservoir for the product, an application member equipped with an application element intended for being placed so as to permanently bear elastically on the product and elastic bearing means exerting a bearing force of the application element on the product. Compensation means are provided to adjust the bearing force to a determined and substantially constant value as the level of product in the reservoir diminishes.

When the product is liquid, it may be advantageous to arrange, in the reservoir, a sponge or a block of compressible, open-cell foam capable of being saturated with the liquid.

In order to be able appropriately to exert the desired bearing force on the product, the reservoir may be equipped with a first piston which can move axially in this reservoir interposed between the product and the application element, one or more passage openings for the product being provided in this piston to ensure loading of the application element with product via this opening. The more product the reservoir contains, the higher this piston will be in the reservoir.

According to a preferred embodiment, the openings made in this piston have the form of slots which are advantageously oriented in a plane which passes through the assembly's axis. These slots may have a length which is substantially equal to or less than the axial length of the application element. The width of such a slot is, for example, from 0.2 mm to 2 mm. Generally speaking, this opening is calibrated according to the nature and the consistency of the product to be removed. It allows the passage of a metered, precise quantity of product.

The first piston may be semi-deformable and be formed from a material such as low-density polyethylenes, high-density polyethylenes, poly-propylenes, polyacetals, elastomers or thermoplastic elastomers.

The first piston also preferably comprises at least one lip which bears on the inner wall of the reservoir. When the assembly is closed, the pressure exerted by the end of the application element on the piston gives rise to a blocking of the openings of the piston, thereby leading to the sealing of the assembly and the loading of a determined quantity of product, while preventing an unexpected flow of product during the storage period, particularly when the assembly is upside-down or in a horizontal position.

The shape of this piston depends on the shape of the end of the application element and vice-versa. The piston may thus preferably have a spherical, oval, planar, pointed, square or triangular shape, depending on whether the application element has a shape chosen from spherical, oval, planar, pointed, square and triangular shapes. Thus, when the application element has a spherical or oval shape, the end of the piston in contact with this application element has a concave shape adapted to the shape of the piston.

According to a preferred embodiment, the piston includes a cavity whose walls are capable of matching at least a portion of the contour of the application element.

According to an advantageous aspect of the invention, the compensation means comprise a dynamometric engagement/disengagement mechanism capable of compressing the elastic bearing means while the bearing force on the piston is below a predetermined threshold and of becoming inoperative when the bearing force on the piston exceeds this predetermined threshold.

According to a particular embodiment, the compensation means consist of a threaded rod carrying the application member which can be actuated by the user by an operating means. Elastic linking means interact, in response to an actuation of the operating means, with the threaded rod when the bearing force on the piston is below the threshold so as to re-establish the initial bearing force after the removal of a metered amount of product. The elastic linking means becomes inoperative when the bearing force on the piston reaches the threshold. As a variant, the threaded rod may be replaced by a rack-type rod interacting with appropriate elastic linking means and producing the same effect as the threaded rod.

Advantageously, the elastic bearing means consist of a helical spring arranged so as to keep the application element, in the assembled position of the assembly, elastically bearing on the product. Of course, any other elastically compressible means may be used, for example a block of foam. When use is made of a helical spring, for example made from metal or plastic, each end of the spring bears elastically on second and third pistons, respectively. In this case, the second piston is advantageously integral with the threaded rod (or rack-type rod), the third piston being integral with a first end of an applicator-holder rod whose second end carries the application element.

According to an advantageous characteristic of the invention, the application member includes a hollow gripping sleeve accommodating the compensation means and the elastic bearing means. The gripping sleeve advantageously consists of two portions which can move relative to each other, one of the portions forming the operating means which allows the bearing force of the piston on the product to be regulated.

According to an embodiment which is simple to produce and easy to implement, the elastic linking means consist of a cylindrical sleeve surrounding the threaded rod, a first free end of the sleeve, bearing elastically against the said threaded rod, including longitudinal slots which delimit a plurality of tabs which can deform elastically in a direction radial to the sleeve. In this way there is obtained a plurality of radially flexible tongues, the free ends of which may include profiles capable of entering the screw thread of the thread of the threaded rod. Therefore, when a predetermined threshold of axial thrust exerted on the rod is not exceeded, the tongues interact with the thread of the rod. When this thrust threshold is achieved by virtue of the radial elasticity of the tongues, the tongues separate and are repositioned on the rod at a level at which the threshold corresponds to the initial threshold.

According to a preferred embodiment, the elastic linking means consist of a cylindrical sleeve surrounding the rod, a first free end of the sleeve bearing elastically against (or gripping) the rod. In this case, the sleeve is produced from an elastomeric material. When the rod is threaded, the first end of the sleeve may advantageously include an inner thread which complements the thread of the rod.

When the first piston includes a cavity in which the application element is entirely accommodated, the second end of the applicator-holder rod includes a frustoconical annular bearing surface which bears in a leaktight manner against the open end of the cavity of the first piston. By means of this arrangement, it is possible to obtain another means for preventing any unexpected flow of product during storage or transportation.

The application element may consist of an end-piece made from low-density elastomer or from foam, of a block made from soft rubber which includes roughnesses, of a felt, of a brush with short, stiff bristles or of a mascara brush. In the case of an end-piece made from foam or from elastomer, it may be provided with a flock covering. Such a covering makes it possible to increase the quantity of product absorbed, particularly when the product has a low viscosity.

When the end-piece is made from foam, the foam is chosen from deformable polyether foams, polyurethane foams, polyester foams or low-density elastomer foams. The low-density elastomers are defined by a shore A hardness ranging from 15 to 90. The foams are preferably chosen from open-cell or closed-cell foams with a pore size ranging from 0.05 mm to 2 mm and preferably from 0.5 mm to 0.8 mm. In particular, they have the appearance of a sponge.

With a view to reducing the cost of the assembly during use, it is possible to design it to be refillable. To this end, it is possible to provide the user with a refill consisting of a reservoir filled with product and closed by the first piston. After the product has been used up, it then suffices to remove the empty reservoir from the application member and to fit a new refill on the latter.

More particularly, the assembly in accordance with the invention may apply to the field of make-up and/or skin care and may, in particular, be used for applying, to the skin or to the nails, teeth, hair, etc. a lip cream, a foundation, a sun-spot concealer, etc.

A further subject of the invention is the use of the assembly as defined above for applying the product contained in the reservoir to the skin, eyelashes or mucus membranes, using the application element.

BRIEF DESCRIPTION OF THE DRAWINGS

The invention will now be described in more detail and in a non-limiting manner with the aid of the appended drawings, in which.

DETAILED DESCRIPTION OF THE PREFERRED EMBODIMENTS

Figure 1:
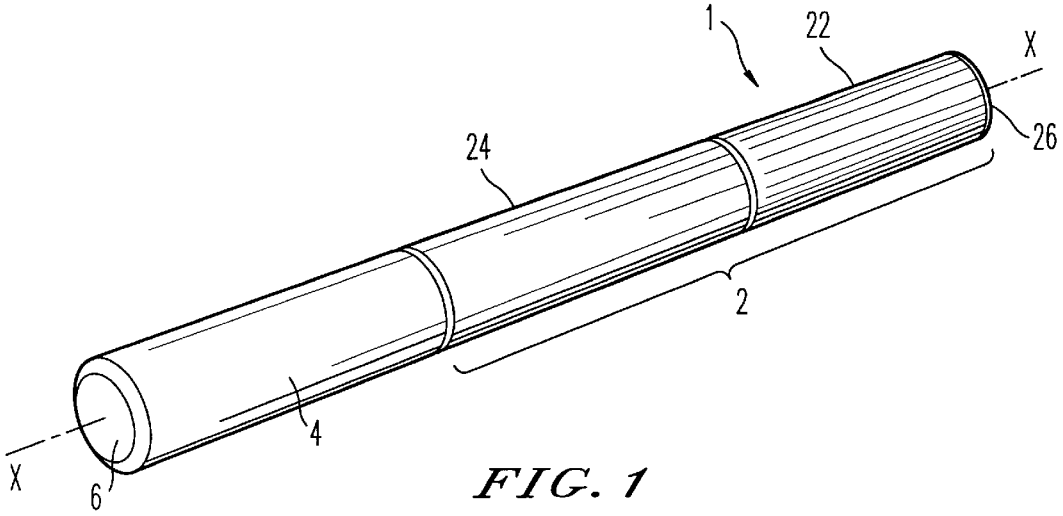
FIG. 1 shows a view in elevation of an assembly in accordance with a first embodiment of the invention.
Figure 4:
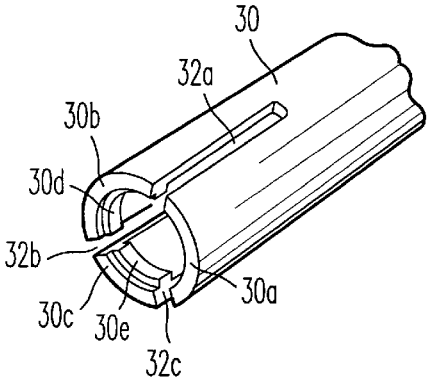
FIG. 4 shows an enlarged perspective view of the elastic linking means, in accordance with the first embodiment of the assembly of the invention.

FIGS. 1 to 4 show a packaging and application assembly 1 in accordance with the invention in the closed position. This device, with axial symmetry X—X, comprises an application member 3 which includes a cap 2, and a hollow body 4, which are intended to be fastened to each other by screwing. The hollow body 4, of cylindrical shape, includes an end wall 6 and forms a reservoir for a product P whose consistency is reasonably viscous. The flow of the product P out of the reservoir 4 by gravity is prevented by the presence of a first piston 8 mounted so as to slide axially in the reservoir 4 and arranged on the side opposite the end wall 6.

The first piston 8 has a generally cylindrical shape and includes, at each of its ends, a sealing annular lip 8*a*, 8*b*. The piston also includes, in its central part, a type of glove finger or thimble 10 which is closed at its lower end 10*a* and open at the opposite end 10*b*. The glove finger 10 thus defines a cavity in which an application end-piece 48, which will be described in greater detail below, may be accommodated.

The side wall of the glove finger has a plurality of openings 12, in this case in the form of longitudinal slots. These slots advantageously have a width such that the product is unable to flow freely through the slots.

The reservoir 4 is capped by an assembling element 14 equipped with a neck 16 which is provided with an external thread 18 intended for cooperating with a complementary thread 20 carried by the cap 2, allowing the reservoir to be closed by screwing.

The cap 2 consists of two portions: an end portion 22, known as the "operating button," and an intermediate portion 24. The operating button 22, of cylindrical shape and with substantially the same diameter as the reservoir 4, is closed by a circular stopper 26. The operating button 22 has an internal annular projection 28 with a cylindrical end wall 28*a* which extends towards the reservoir. The cylindrical end wall 28*a* ends in three regularly distributed tongues 30*a*–30*c* (see also FIG. 4). These tongues form a sleeve 30 of general cylindrical shape and are separated from one another by longitudinal slots 32*a*–32*c* which are parallel to the axis X—X. The end of each tongue includes an inner profile 30*d*, 30*e* capable of interacting with the thread 34 of a rod 36 mounted axially inside the operating button 22 and whose role will be explained below. Owing to their small thickness, the ends of the tongues 30*a*–30*c* are radially flexible.

The cap 2 includes a cylindrical end-piece-holder rod 46 which is equipped with an application end-piece 48. The cap/rod/end-piece assembly forms the application member 3 mentioned above.

The intermediate portion 24 is attached in line with the operating button 22, on the side opposite the stopper 26. This intermediate portion is free to rotate relative to the operating button 22 via a snap-fit system with an annular bead 38/annular groove 39. The operating button 22 can thus be turned by the user relative to the intermediate portion 24.

A second piston 40 (on the operating button 22 side) and a third piston 42 (on the side facing the reservoir 4), which are capable of sliding axially, are slideably arranged inside the intermediate portion 24. A helical spring 44 is placed, under compression, between these two pistons. The second piston 40 is integral with the threaded rod 36, while the third piston 42 is integral with the end-piece-holder rod 46 which extends beyond the neck 16 in the reservoir. To prevent the threaded rod 36 from rotating, the second piston 40 and the inner wall of the intermediate portion 24 are provided with anti-rotation striations and/or grooves (not shown).

On the side opposite the piston 40, the end-piece-holder rod 46 carries the application element 48 in the form of an end-piece made from flexible or semi-rigid foam, the free end 48*a* of which is rounded. This foam is advantageously a semi-open-cell foam which has, for example, a mean pore size of approximately 0.8 mm. The external diameter of the application element 48 corresponds substantially to the internal diameter of the glove finger 10. It should be noted that the end-piece-holder rod 46 has a diameter which is greater than the diameter of the application end-piece 48 so that a frustoconical bearing surface 50 is formed between the rod 46 and the second end 46*b* of the end-piece 48. In the assembled position of the assembly 1, the bearing surface 50 bears in a leaktight manner against the open end 10*b* of the glove finger 10. This prevents the product P contained in the cavity 11 from rising, by capillary action, towards the upper surface 10*b* of the piston 8 and consequently from flowing into the space located above the piston, formed between the assembly element 14 and the end-piece-holder rod 46.

As a variant, it is possible to use an end-piece made from preflocked elastomer. It is also possible to fit a mascara brush as the application element.

It should be noted that the intermediate portion 24 carries an annular inner lip 52 arranged at the end of the thread 20. This annular lip 52 has a free edge facing the reservoir, defining a cylindrical orifice 54 for the passage of the applicator-holder rod 46. This lip has several roles. On the one hand, it scrapes the rod 46 during extraction/assembly of the application member 3. On the other hand, it guides the application member during insertion or extraction of the application element into or from the reservoir. Finally, it provides the assembly, in the storage position, with a leaktight seal between the neck 16 and the cap 2.

The cap 2, reservoir 4 and applicator-holder rod 46 assembly are produced from rigid plastic material, for example from polyethylene.

The assembly 1 operates as follows: after having removed and applied a metered amount of product P, the user screws the cap 2 onto the assembly element 14. This compresses the spring 44, giving rise to pressure from the end 48*a* of the application element 48 on the first piston 8. Consequently, due to the pressure of the piston 8 on the product P, the product flows through the slots 12 which, in turn, loads a precise quantity of product on the application element by absorption. After saturation of the application end-piece 48, the slots 12 are blocked and all supply of product automatically stops.

The application member 3 may then be extracted from the reservoir. At this time, no further pressure is exerted on the piston, so that the product no longer passes through the slots 12. The product removed on the application element may then be applied to the skin or to mucous membranes.

Prior to a further application of product, the user rotates the operating button 22 with respect to the intermediate portion 24. This rotation advances the second piston 40 towards the application end-piece 48. During this operation, the spring 44 is compressed between the second piston 40 and third piston 42 to a compression level which corresponds to a predetermined bearing force for obtaining a desired level of loading of product on the end-piece 48. When the predetermined compression threshold (or nominal compression) has been achieved or exceeded, the profiles 30*d*, 30*e* of the tongues 30*a*–30*c* disengage from the screw thread 34 of the threaded rod, so that these profiles engage on the threaded rod one or more notches further on, in order to restore the nominal compression level of the spring 44. By means of this dynamometric engagement/disengagement system, the load of product on the application end-piece is always substantially the same irrespective of the filling level of the reservoir 4.

Figure 2:
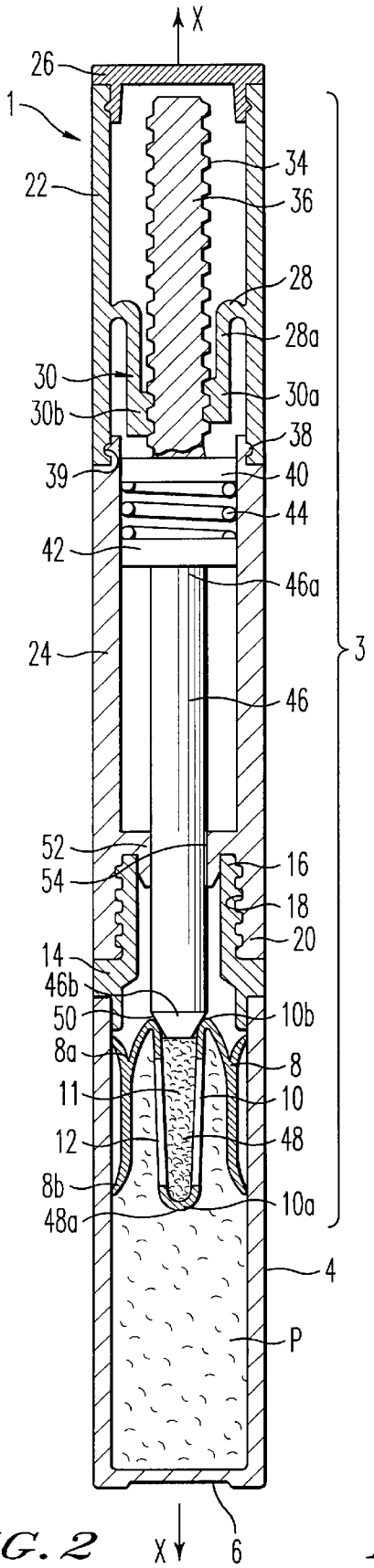
FIG. 2 shows a longitudinal sectional view of the assembly of FIG. 1, shown at the start of use.

FIG. 2 shows the spring 44 compressed in the rest position. During an extended storage period, it is advantageous to position the second piston 40 in such a position that the spring 44 is relaxed.

Figure 5:
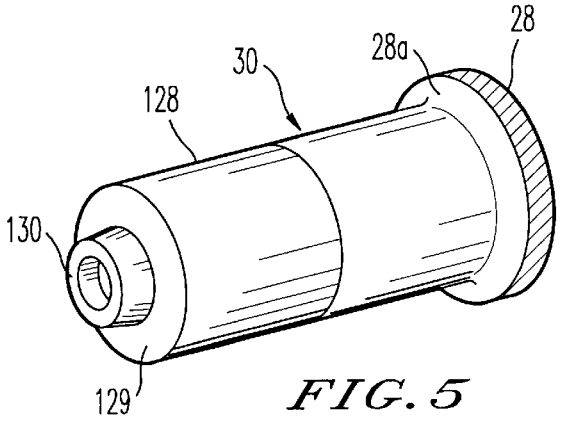
FIG. 5 shows a perspective view of the elastic linking means, in accordance with a second embodiment of the assembly of the invention.
Figure 6:
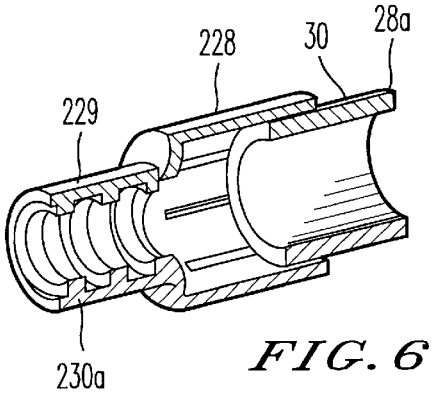
FIG. 6 shows a longitudinal sectional view of the elastic linking means, in accordance with a third embodiment of the assembly of the invention.

The devices shown in FIGS. 5 and 6 show other embodiments of the dynamometric engagement/disengagement system of the assembly of the invention which can be adapted to the mechanism described above.

FIG. 5 shows a sleeve 30 carrying a cylindrical component 128 whose front face 129 carries an annular bead 130. The internal diameter of this bead is less than the external diameter of the threaded rod 36. The component 128 is produced from flexible or semi-rigid elastomer, fulfilling the same function as that fulfilled by the flexible tongues 30*a*–30*c* in accordance with the first embodiment described above.

FIG. 6 shows the mounting of a component 228 made from elastomer, whose function and construction are similar to those of the component 128 in FIG. 5, with the difference that the bead 129 has been replaced by a sleeve 229 carrying a thread 230*c* capable of interacting with the thread 34 of the rod 36. By virtue of the elasticity of the material used, the rod remains engaged on the components 128, 228 until the predetermined bearing-force threshold of the application end-piece on the piston has been achieved. Exceeding this threshold causes the disengagement of the rod 36 and the components 128, 228.

Figure 7:
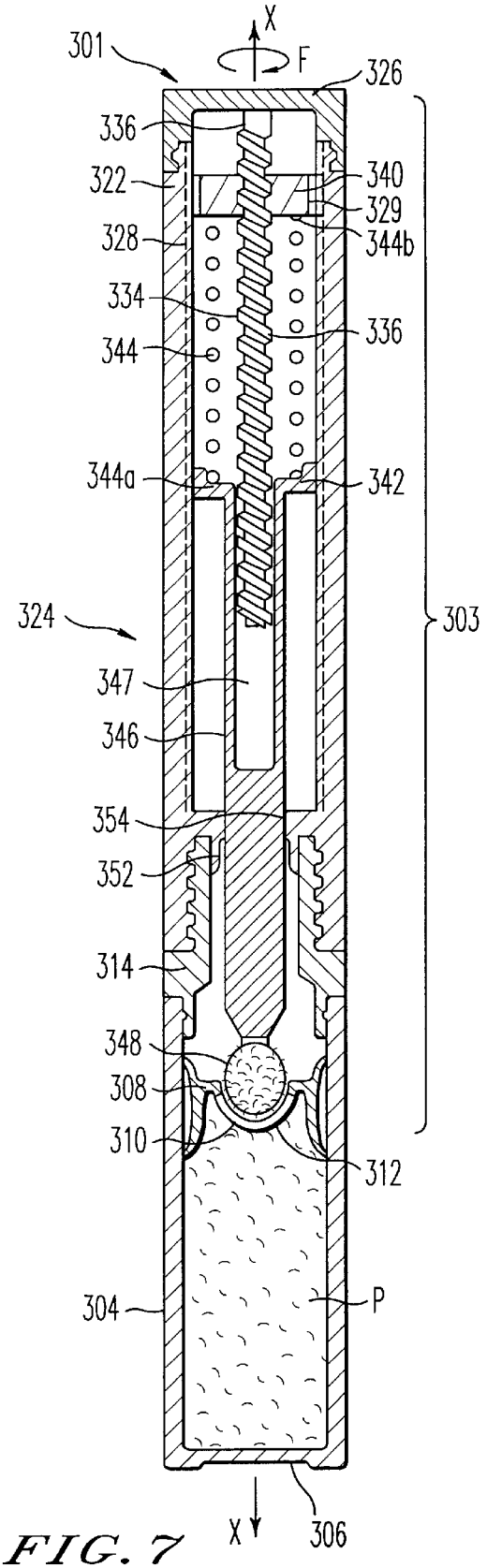
FIG. 7 shows a longitudinal sectional view of a further embodiment of the invention, the assembly being shown at the start of use.

FIG. 7 shows an assembly 301 in accordance with a further embodiment. In this Figure, parts which are identical or similar to those of FIGS. 2 and 3 bear the same reference numerals increased by 300. They will be described only in part.

Figure 3:
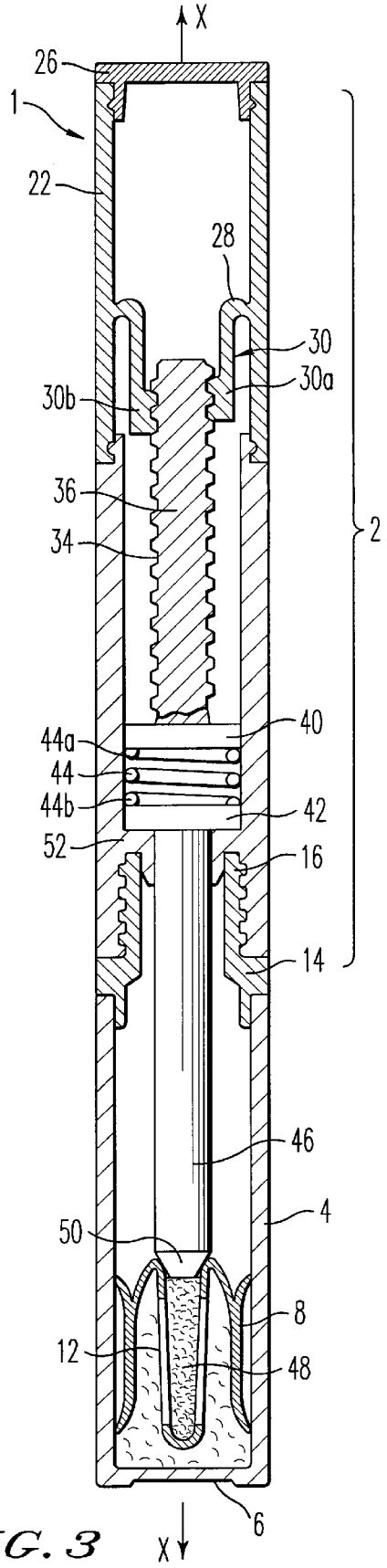
FIG. 3 shows a longitudinal sectional view of the assembly of FIG. 1, shown at the end of use.

Compared with the embodiments in FIGS. 2 and 3, the dynamometric engagement/disengagement system in FIG. 7 has been simplified. Thus, the application member 303 includes a rod 346 whose entire upper end 347 is hollow. The rod 346 ends in a cylindrical piston 342 mounted so as to slide in the intermediate portion 324. An operating button 326 is mounted, free in rotation, on the upper end of the intermediate portion 324. The operating button 326 includes a central rod 336 equipped with a thread 334. This rod extends into the hollow part 347 of the rod 346 where it is held laterally. The central rod 336 is engaged in a corresponding internal thread of a piston 340 mounted so as to slide in the upper part of the intermediate portion 324. A helical spring 344 is mounted under compression between the piston 340 and the piston 342. This piston 340 is made from an elastomeric material. By virtue of the elasticity of this material, the rod 336 is able to interact with the piston until a predetermined bearing force of the spring 344 has been exceeded. Beyond this predetermined bearing force, the thread 334 and the corresponding thread of the piston are disengaged by the piston 340 being moved down by rotating the operating button 326. In this way, it is possible to guarantee a substantially constant compression of the spring 344 and, consequently, a constant bearing force of the application element 312 on the piston 308.

To prevent the piston 340 from rotating, it includes, on its side wall, longitudinal ribs 329 which interact with longitudinal grooves on the inside of the inner wall of the intermediate portion 324. After each use, a rotation of the operating button 326 relative to the median portion 324 causes the piston 340 to descend on the threaded rod 336 and thus makes it possible to re-establish the bearing force of the application element 348 on the piston 308 during the successive uses of the product P. It should be noted that the shape of the application element 348 is substantially spherical. As a consequence, the shape of the glove finger 310 of the piston 308 has a complementary hemispherical shape.

Figure 8:
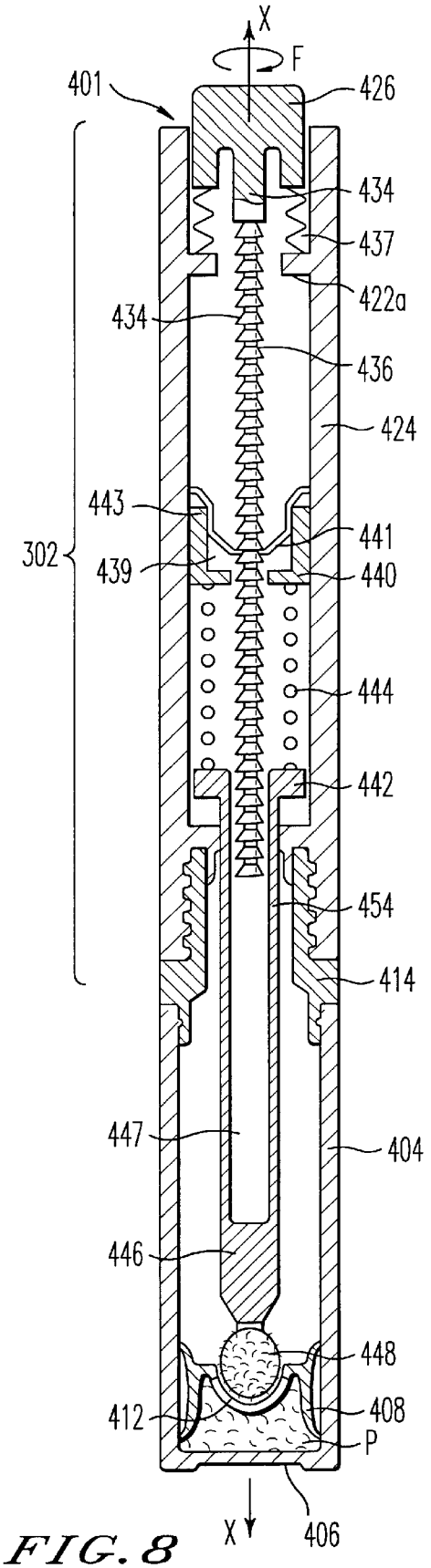
FIG. 8 shows a longitudinal sectional view of a further embodiment of the invention.

The application assembly 401 shown in FIG. 8 includes a rack-type system 436. In this Figure, the parts which are identical or similar to those in FIGS. 2 and 3 bear the same reference numbers increased by 400. They will be described only in part.

In FIG. 8, the application assembly 401 includes an intermediate portion 424 equipped, on the inside of its upper part, with an annular internal projection 422*a* on which an elastically compressible bellows 437 bears. The end wall of this bellows is fastened to the annular projection 422*a* by gluing or welding or by any other appropriate means. The upper end of the bellows 337 is integral with a push button 426 emerging axially from the intermediate portion 424. The push button 426 includes a rod 436 with rack 434. A piston 440 is slideably mounted inside the intermediate portion, the piston bearing elastically against a spring 444. In turn, the spring bears against a piston 442 integral with the rod 446 which carries the application element 448. The piston 440 carries an internal ring 439 which includes both a plurality of attachment fins 441 which are elastically deformable radially to bear against the rod 436 with rack 434, and a plurality of non-return fins 443 which bear elastically against the inner cylindrical wall of the intermediate portion 424.

The assembly 401 operates as follows: when the user bears on the push button 426, as symbolized by the arrow F, the rod 436 causes the piston 440 to descend, which compresses the spring 444 and, consequently, causes the application element 448 to bear on the piston 408. When the push button is relaxed, the bellows 437 brings it back to its initial position. At the same time, the rod 436 moves back and the attachment fins 441 lodge on a lower notch of the rack 434. During this operation, the piston remains in position, held by the non-return fins 443. Thus, by bearing successively on the push button, the spring 444 is compressed up to a predetermined compression force. When this force is exceeded, the fins 441 separate and are positioned on a notch where the compression force corresponds to its nominal value.

In the embodiment in accordance with FIGS. 7 and 8, the end wall of the reservoir 304, 406 consists of an attached stopper 306, 406 which, prior to its being placed in position, allows the reservoir 304, 404 to be filled with product P and/or the piston 308, 408 to be fitted.

Figure 9:
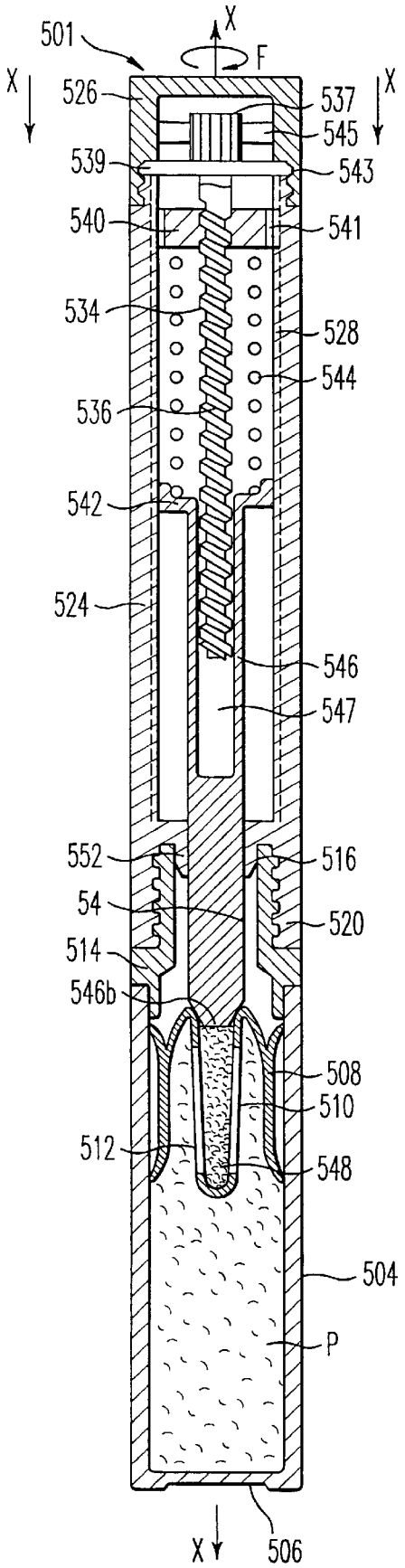
FIG. 9 shows a longitudinal sectional view of yet a further embodiment of the invention.
Figure 10:
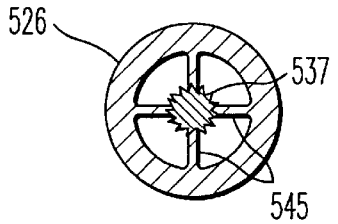
FIG. 10 shows a transverse sectional view through the plane X—X of FIG. 9.

FIGS. 9 and 10 show an embodiment of an application assembly 501 which is distinguished from the embodiment of FIGS. 2 and 3 in that the engagement/disengagement system consists of a notched roller wheel 537. This roller wheel is mounted on the upper end of a threaded rod 536 and interacts with fins 545 extending radially inside an operating button 526 mounted in rotation on the intermediate portion 524 of the assembly (see also FIG. 10). The rod 536 is held in position by a disc 539 arranged in a recess 543 formed between the intermediate portion 524 and the operating button 526. The threaded rod 536 interacts with a piston 540 equipped with an appropriate thread. This piston 540 is able to slide axially inside the intermediate portion 524, longitudinal ribs 541 being provided on its periphery, interacting with corresponding grooves 528 made in the inner wall of the intermediate portion 524, thereby preventing the rotation of the piston 540. The piston 540 bears against a spring 544 which itself bears against the piston 542 which carries the application element 548.

By rotating the operating button 526 in the direction of the arrow F, the rod 536 is rotated and the piston 540 descends and compresses the spring 544. When a predetermined compression level is attained, the elastic fins 545 can no longer entrain the roller wheel 537. Thus, the nominal value of the compression force of the spring cannot be exceeded and the bearing force of the application element on the product may be kept substantially constant throughout use of the product.

The invention thus makes it possible, by a substantially constant bearing of the application element 48, 348, 448, 548 on the piston 8, 308, 408, 508, to load the application end-piece with a substantially constant quantity of product, irrespective of the filling level in the reservoir. Moreover, the assembly according to the invention allows precise removal of products with very different viscosities (wide viscosity range). To this end, it suffices to fit a spring which has an appropriate return force and suitably calibrated dynamometric engagement/disengagement means. If appropriate, the dimension of the opening 12, 312, 412, 512 made in the piston 8, 308, 408, 508 should be adjusted.

Such an assembly with a perforated piston also makes it possible to use practically all the product in the reservoir, irrespective of its viscosity. Moreover, this device prevents the drying-out of a product which has a tendency to dry out by virtue of the presence of this piston, which is advantageous when the product is used in small quantities over a long period. In addition, the product can be applied gently since, at the time of application, contact between the skin and the application end-piece 48 is dampened by virtue of the elastic mounting of the application element on the spring 44.

The present invention is not restricted to the embodiments described, which are given solely by way of illustration. Thus, it is conceivable to fit a product reservoir with a closed end wall in a body, so that it can move axially. In such a case, the application member consists of a fixed rod whose end is connected to a cap, the other end being integral with an application end-piece. In this case, the end wall of the reservoir is in contact with a spring which is itself mounted on compensation means such as described above.

I claim:

1. An assembly for packaging and applying a pulverulent, liquid or pasty product, comprising:

a reservoir for the product;

a removable application member having an application element positionable so as to apply a bearing force on the product;

elastic bearing means for elastically exerting a bearing force of said application element on the product; and compensation means for adjusting the bearing force to a determined and substantially constant value for any level of product in the reservoir.

2. The assembly according to claim 1, wherein the compensation means comprise a dynamometric engagement/disengagement mechanism capable of compressing said elastic bearing means only when said bearing force exerted by the elastic bearing means is below a predetermined threshold.

3. The assembly according to claim 2, wherein the compensation means comprises:

a threaded rod or a rack carrying the application member;

a manually actuatable operating element;

elastic linking means responsive to movement of the operating element and interacting with the threaded rod or the rack when the bearing force on the piston is below the threshold so as to reestablish an initial bearing force after dispensing a metered amount of product, the elastic linking means being inoperative when the bearing force on the piston reaches said threshold.

4. The assembly according to claim 3, wherein the application member includes a hollow gripping sleeve in which the compensation means and the elastic bearing means are housed, the gripping sleeve including two portions which can move relative to each other, one of said portions forming said operating element.

5. The assembly according to claim 3, wherein the elastic linking means includes a cylindrical sleeve surrounding the threaded rod, and wherein a first free end of the sleeve bears elastically against the threaded rod and includes longitudinal slots which delimit a plurality of elastically deformable tabs in a direction radial to the sleeve.

6. The assembly according to claim 5, wherein the first end of the sleeve includes an inner thread which complements the thread of the threaded rod.

7. The assembly according to claim 3, wherein the elastic linking means includes a cylindrical sleeve surrounding the threaded rod, and wherein a first free end of the sleeve bears elastically against the said threaded rod, the sleeve being formed from an elastomeric material.

8. The assembly according to claim 1, wherein the elastic bearing means comprises a spring arranged so as to hold the application element so as to bear elastically on the product.

9. The assembly according to claim 1, wherein the reservoir includes a first piston which can move axially in the reservoir, said first piston being interposed between the product and the application element, at least one passage opening for the product being provided in said first piston, to load the application element with the product.

10. The assembly according to claim 9, wherein the first piston includes a cavity whose walls match at least a portion of the contour of the application element, said at least one passage opening forming at least one supply channel for the application element.

11. The assembly according to claim 1, wherein the elastic bearing means comprises a helical spring, each end of the spring bearing elastically on second and third pistons, respectively.

12. The assembly according to claim 11, wherein the second piston is integral with a threaded rod, the third piston being integral with a first end of a rod whose second end carries the application element.

13. The assembly according to claim 12, wherein the second end of the rod includes a frustoconical annular bearing surface which bears in a leaktight manner against an open end of the cavity.

14. The assembly according to claim 1, wherein the application element comprises one of an elastomeric end-piece, a foam end-piece and a mascara brush.

15. The assembly according to claim 14, wherein the end-piece is provided with a flock covering.

16. An assembly for packaging and applying a pulverulent, liquid or pasty product, comprising:

a reservoir for the product;

a removable application member having an application element positionable so as to apply a bearing force on the product;

an elastic element exerting a bearing force of said application element on the product; and a mechanism which compresses said elastic element and prevents said bearing force on the piston from exceeding a determined threshold.

* * * * *